United States Patent [19]

Spang et al.

[11] Patent Number: 4,652,179

[45] Date of Patent: Mar. 24, 1987

[54] METHOD OF AND DEVICE FOR SEVERING A TENSION MEMBER IN A PRESTRESSED GROUTED ANCHOR

[75] Inventors: Konrad Spang, Munich; Thomas Herbst, Wessling, both of Fed. Rep. of Germany; Urs Kellner, Küsnacht, Switzerland

[73] Assignee: Dyckerhoff & Widmann Aktiengesellschaft, Munich, Fed. Rep. of Germany

[21] Appl. No.: 569,782

[22] Filed: Jan. 10, 1984

[30] Foreign Application Priority Data

Jan. 13, 1983 [CH] Switzerland ..... 159/83

[51] Int. Cl.[4] ..... E21D 20/02; E02D 5/54

[52] U.S. Cl. ..... 405/260; 405/303; 52/232; 29/426.4

[58] Field of Search ..... 405/130, 131, 234, 235, 405/258–260, 262, 303; 52/223 L, 223 R, 232, 1; 225/93.5, 100; 140/123.6, 139; 29/426.1, 426.2, 426.4, 426.5

[56] References Cited

U.S. PATENT DOCUMENTS

| | | | |
|---|---|---|---|
| 1,689,131 | 10/1928 | Goodwin | 52/1 |
| 2,612,063 | 9/1952 | Wangelin | 225/100 X |
| 2,737,802 | 3/1956 | Bakker | 52/232 X |
| 2,871,750 | 2/1959 | Parrish | 29/426.4 X |
| 3,738,071 | 6/1973 | Finsterwalder | 405/260 X |
| 3,936,924 | 2/1976 | Ichise et al. | 405/259 X |
| 3,950,905 | 4/1976 | Jeter | 52/659 X |
| 3,993,524 | 11/1976 | Okada et al. | 29/426.4 X |
| 4,132,498 | 1/1979 | Ikeda et al. | 405/259 |

FOREIGN PATENT DOCUMENTS

| | | | |
|---|---|---|---|
| 2443282 | 1/1976 | Fed. Rep. of Germany | 405/259 |
| 2428729 | 12/1981 | Fed. Rep. of Germany . | |

*Primary Examiner*—Dennis L. Taylor
*Assistant Examiner*—Nancy J. Stodola
*Attorney, Agent, or Firm*—Toren, McGeady and Goldberg

[57] ABSTRACT

A prestressed grouted anchor has a portion of an axially extending prestressed tension member grouted in a receiving material while the remaining portion of the tension member extends from the grouted portion. The remaining portion is separated from the grouted portion at a selected breaking point by reducing the tensile strength of the tension member as the result of exposing it to the action of heat, such as developed in an exothermic chemical reaction. If the tension member is prestressed and the resulting elastic elongation is maintained during the heating action with the elongation being greater than the elongation required under the heating action for effecting the severing of the tension member, then with progressive heat the tensile strength of the tension member is reduced and the elastic elongation progressively changes to plastic elongation with the tension member finally severing automatically at the selected breaking point.

17 Claims, 8 Drawing Figures

FIG. 1
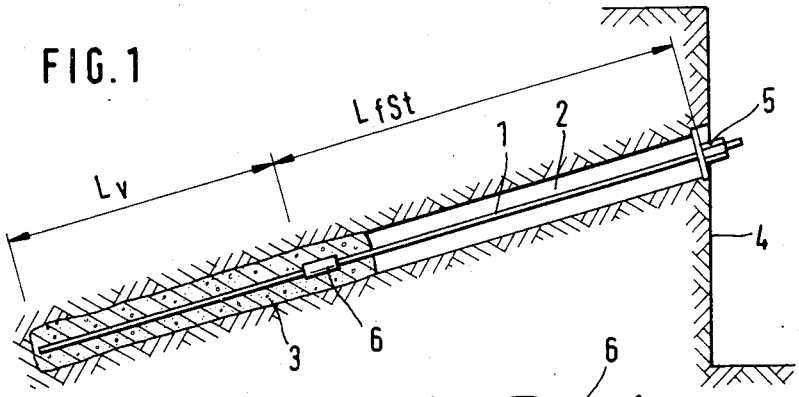
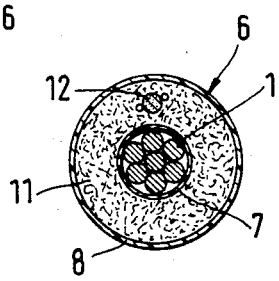
FIG. 3
FIG. 2
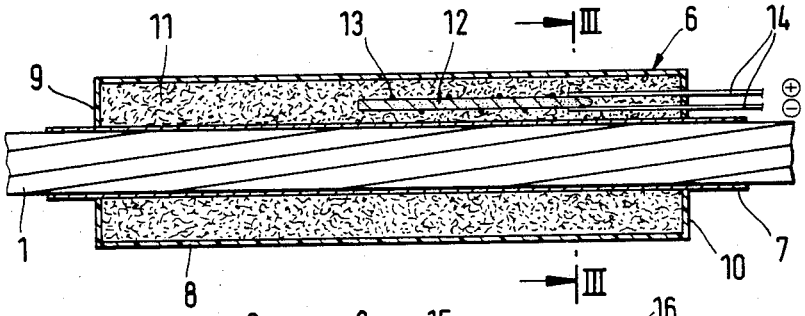
FIG. 4
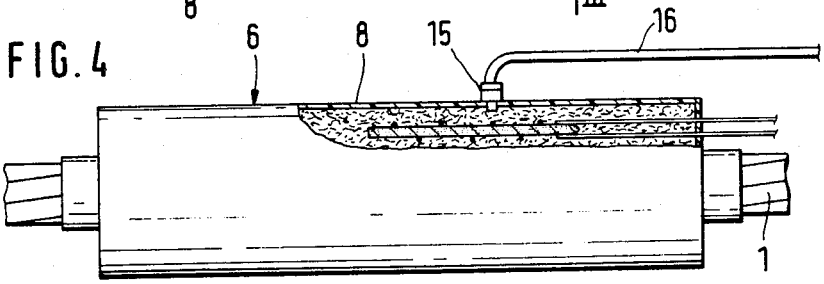
FIG. 5
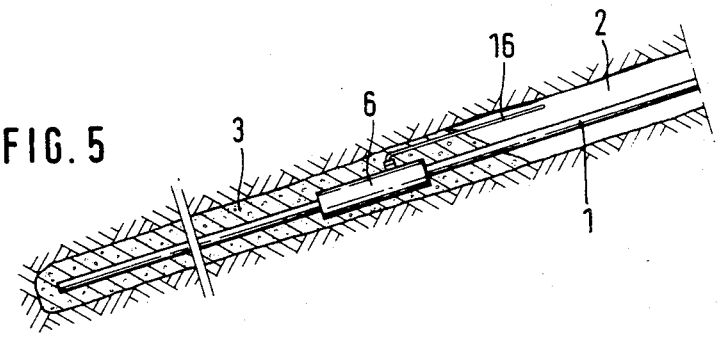

METHOD OF AND DEVICE FOR SEVERING A TENSION MEMBER IN A PRESTRESSED GROUTED ANCHOR

SUMMARY OF THE INVENTION

The present invention is directed to a method of removing the portion of a tension member in a prestressed grouted anchor which extends from the grouted portion. The removal is effected by severing the two portions of the tension member, particularly at the location of the junction between the grouted portion and the free portion of the tension member. A selected breaking point is formed by reducing the tensile strength of the prestressed tension member by applying heat to the member, especially in an exothermic chemical reaction. Further, the invention relates to a device for providing the heating action at the desired breaking point.

A grouted anchor includes a tension member which is introduced into a borehole in a receiving material and at the base of the borehole the tension member is grouted in using a hardenable or settable material, such as a cement grout or the like. A grouted anchor is secured to a structural member to be anchored by means of the remaining portion of the tension member extending from the grouted portion. The tension member may be formed as one or more elements made up of steel rods, wires or cables. The length of the tension member embedded in the grout is called the anchored length $L_v$, the remaining portion of the member, which is freely expandible under prestress, is called the free length $L_{fst}$. Such grouted anchors may be used as permanent anchors, that is, serving to permanently anchor a structure, or they may be used temporarily, such as for anchoring the wall of an excavation. If such a temporary grouted anchor extends into an adjacent lot, as a rule, it must be removed after the completion of the construction operation in which it is used.

To remove a grouted anchor, usually a breaking point or severing location is provided at the transition between the anchored length $L_v$ and the free length $L_{fst}$ so that the free length can be pulled out of the borehole and recovered, if it is desired to do so. The grouted portion, which is usually in the range of 4 to 8 m, is easily removed when surface earth moving is carried out in the adjacent lot, such as with bulldozers.

There are various possibilities for breaking or severing the tension member in a grouted anchor and the most important is the use of heat to reduce the tensile strength of the steel in the tension member, because the means for generating the heat can be installed along with the tension member without appreciably increasing the diameter of the borehole. Further, the heating means can be maintained operational for a relatively long period of time. Moreover, if the desired breaking point is produced by a reduction in strength caused by heat, the full transverse cross-section of the tension member can be used during its entire period of utilization.

In producing the heat required for reducing the tensile strength of the tension member, it has been known to heat the tension member by an electric heating element, and also to generate the heat by induction using a coil encircling the tension member at the desired breaking point. Another known method involves heating the tension member in the region of the breaking point by means of an exothermic chemical reaction, such as obtained from an aluminothermic mixture with the tension member being heated to a temperature at which its tensile strength is reduced so that it can be easily severed and pulled out of the borehole.

During the installation of grouted anchors, in particular for stressing the tension members, prestressing jacks are available particularly for anchors of high load capacity and such equipment is very costly to handle. In the removal of the anchors it is important not to require any equipment or at least any heavy equipment.

Therefore, it is the primary object of the present invention to provide the separation of the tension member in an automatic operation using the action of heat on the member.

In accordance with the present invention, the tension member is prestressed so that its elastic elongation is maintained during the heating operation and is greater than the elongation required to achieve the separation of the tension member under the action of the heat.

As the elastic elongation of the tension member depends mainly on its free length, it is important to match the magnitude of the prestressing force to the free length so that during the heating operation the tension member severs automatically. Accordingly, it is possible to replace and/or increase the elongation due to the prestressing force at least while the heating operation is in effect by the action of external and axially acting forces. Such additional forces can be attained by spring elements acting on the tension member.

Further, it is also possible to reduce the elongation required for severing the tension member under the action of heat by applying other external forces. Preferably such forces are obtained by applying forces acting at the desired breaking point transversely of the axial direction of the tension member, or by subjecting the tension member to dynamic stresses.

In addition, it is possible to reduce the elongation required for severing the tension member under the action of heat by controlling the heat supply. Such control can be achieved by regulating the quantity of heat supplied per unit of time and/or by regulating the duration of the heating action or determining the dimensions of the area at which heat is applied, particularly the axial length of the area over which heat is applied, and determining these various factors based on the free length $L_{fst}$.

In accordance with the present invention, the elastic elongation of the tension member due to prestressing is greater than the elongation required under the action of heat for achieving the severing or breaking of the tension member, with the progressive heating of the tension member its tensile strength is reduced so that the elastic elongation gradually transforms into a plastic elongation with the tension member separating at the selected breaking point. As tests have shown, the separation of the portions of the tension member does not take place suddenly, but rather as a result of the gradual reduction of the prestressing force by increased elongation. After the tension member breaks, the free portion can be removed out of the borehole by applying only limited force.

In the invention, the heating action developed in an aluminothermic reaction has proved to be especially advantageous. The materials required for such a reaction, a mixture of aluminum shot and iron oxide powder, can be easily ignited by an ignition rod accommodated relatively easily in a ring sleeve assembly laterally enclosing the tension member. With such a ring sleeve assembly no appreciable increase in the borehole diameter is needed. With the appropriate composition of the mixture, the amount of heat can be determined quantitatively by the reaction velocity and reaction temperature, and by means of the external dimensions of the sleeve assembly, the amount of heat can be determined qualitatively, for example, by using a large diameter and a short length the location of the area of heat development can be limited, leading to a reduction in the elongation required for severing the tension member.

Accordingly, the invention includes a device for establishing the desired breaking point. The device is made up of a ring sleeve assembly laterally enclosing a portion of the tension member in the region of the selected breaking point. The ring sleeve assembly is filled with an aluminothermic reaction mixture with an electrically actuatable ignition system embedded in the mixture. The ring sleeve assembly includes a relatively thin-walled inner sleeve of a readily burnable and/or heat-conducting material and a thicker-walled outer sleeve formed of a heat insulating material.

The inner sleeve may be formed of a plastics material, that is, a material which has sufficient strength but at the same time burns rapidly due to the heating action, whereby the aluminothermic mixture is quickly placed in direct contact with the tension member. Alternatively, the inner sleeve may be formed of metal, for instance, steel sheet, which has the advantage that the heat from the aluminothermic reaction is transferred quickly to the tension member and is maintained over a relatively long period of time.

Appropriately, the outer sleeve is formed of a plastics material, a ceramic or the like so that the heat developed in the reaction is not transferred prematurely or excessively to the outside.

Preferably, the ignition system consists of a stable rod-shaped pyrotechnic mixture which is in direct contact with a power line through which current can be supplied. In one arrangement, the rod-shaped mixture is encircled spirally by the power line.

A pressure relief line may be connected to the ring sleeve assembly which extends into a portion of the borehole free of the grout. Preferably, the pressure relief line is connected to the ring sleeve assembly by a one-way valve.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a schematic showing of a grouted anchor in axially extending section and incorporating the present invention;

FIG. 2 is an enlarged axially extending section through a ring sleeve assembly filled with an aluminothermic mixture;

FIG. 3 is a cross-sectional view taken along the lines III—III in FIG. 2;

FIG. 4 is a side view of another embodiment of the ring sleeve assembly shown in side view and partially in axially extending section;

FIG. 5 is a partial axially extending section through a grouted anchor including a ring sleeve assembly as shown in FIGS. 4–5.

DETAILED DESCRIPTION OF THE INVENTION

Figure 6:
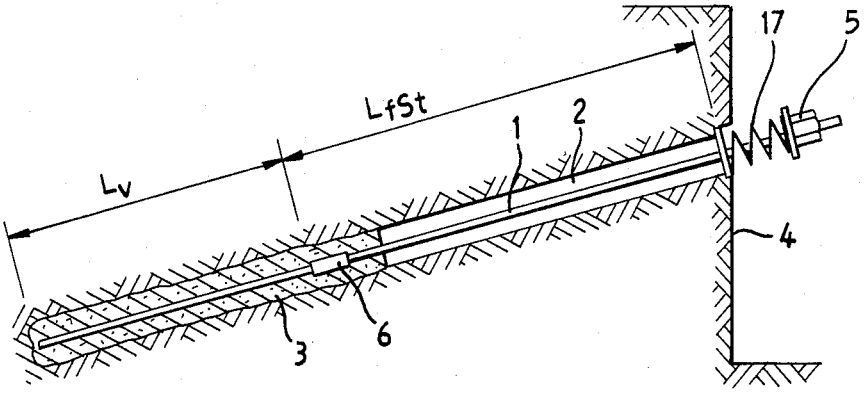
FIG. 6 is a schematic showing, similar to FIG. 1, with externally axially acting forces applied to the grouted anchor.

In FIG. 1 an axially extending section is provided through a grouted anchor including a steel tension member 1, such as a steel cable, inserted into a borehole 2 formed in a receiving material. A body of grout 3 is injected into the inner portion of the borehole 2 and provides an anchor for the inner end of the tension member 1. The body of grout 3 is a hardenable material, such as a cement grout. Within the body of grout 3, the tension member extends for an anchored length $L_v$. Outwardly from the body of grout 3 the remaining portion of the tension member is free and has a free length $L_{fst}$ so that the member 1 is freely expandable and is anchored at the entrance end of the borehole for supporting an excavation wall 4 by a device 5, however, such a device does not form a part of the invention.

In the transition region of or at the junction between the anchored length $L_v$ and the free length $L_{fst}$ of the tension member, a device 6 is embedded in the body of grout 3 for providing heat to the tension member 1 so that a selected breaking point can be established where the tension member is severable whereby its portion extending for the free length $L_{fst}$ can be pulled out of the borehole 2.

An embodiment of the device 6 for forming a selected breaking point is shown in axially extending and transverse sections in FIGS. 2 and 3.

The device 6 is a ring sleeve assembly made up of an inner sleeve 7 and an outer sleeve 8 with the outer sleeve having opposite end walls 9, 10 extending transversely of the axial direction of the tension member 1. As illustrated in FIG. 2, the inner sleeve 7 is slightly longer than the outer sleeve 8 so that the inner sleeve projects outwardly from each of the end walls 9, 10. Further, the inner sleeve is formed of a thin, readily burnable material or of a thin sheet metal. In comparison to the inner sleeve 7, the outer sleeve 8 has thicker walls and is formed of a heat-insulating material, such as a plastics material or a ceramic material.

While the inner sleeve 7 fits closely around the tension member 1, the outer sleeve 8 is spaced radially outwardly from the inner sleeve so that an annular space is formed between the two sleeves. A mixture 11 capable of an exothermic chemical reaction is filled into the space between the sleeves. A particularly suitable aluminothermic mixture of aluminum shot and iron oxide powder can be used as the mixture 11. For ignition of the mixture 11, an ignition system is provided including a rod-shaped igniter 12 and an ignition line 13 of electically conductive materials which extend spirally around the igniter. The ignition line 13 is, in turn, connected to a power cable 14. The conducting cross-section of the ignition line 13 is dimensioned relative to the cable 14 so that it becomes incandescent as soon as current is passed through it and immediately fires the igniter 12. The igniter is a shaped and form-stable pyrotechnic mixture known per se, which burns at a high temperature and contains oxygen-yielding compounds whereby for combustion no atmospheric oxygen is required. The igniter 12 serves to initiate the exothermic chemical reaction in the aluminothermic mixture 11.

Depending on the composition of the aluminothermic mixture, pressure may build up during the reaction. As a rule, such pressure is absorbed by the hardened body of grout 3 in which the ring sleeve assembly 6 is embedded. The body 3 also affords corrosion protection. If undesirable effects on the environment are to be prevented, the pressure may be reduced by inserting a one-way valve 15 into the outer sleeve 8 of the ring sleeve assembly, note FIG. 4. The valve 15 is connected to a pressure relief line 16 extending through the body of grout 3 to the portion of the borehole 2 which is free of the grout, note FIG. 5. In this arrangement, any excessive pressures developed during the reaction can be released without any danger.

An essential feature of the invention is that the ring sleeve assembly 6 can be placed into the borehole 2 along with the tension member of the grouted anchor, since the ring sleeve assembly requires little in the way of additional space radially outwardly from the tension member. Accordingly, with the insertion of the tension member into the borehole all the measures required for the subsequent heat reaction and the formation of the selected breaking point are taken care of. By applying electric power to the cable 14, the igniter starts to burn causing the mixture to react. Depending on the composition of the mixture and the length and diameter of the ring sleeve assembly, in a relatively short time the selected breaking point is formed while maintaining the tension on the tension member 1 with the automatic severing of the tension member in the region of the ring sleeve assembly. When the free length $L_{fst}$ is separated from the anchored portion of the tension member, it can be easily pulled out of the borehole 2. As pointed out above, the tension member is prestressed and its elastic elongation is maintained during the heating action so that the elastic elongation is greater than the elongation required under the heating action to effect the severing of the tension member into its separate portions. As the heat from the exothermic reaction progresses, the tensile strength of the tension member is reduced with the elastic elongation progressively changing over to plastic elongation until the tension member finally separates automatically at the selected breaking point.

As shown in FIG. 6, a spring 17 can be placed on the tension member 1 at the surface of the receiving material for replacing and/or increasing the elongation due to the pre-stressing force at least while the heating operation is in effect by the action of external and axially acting forces.

Figure 7:
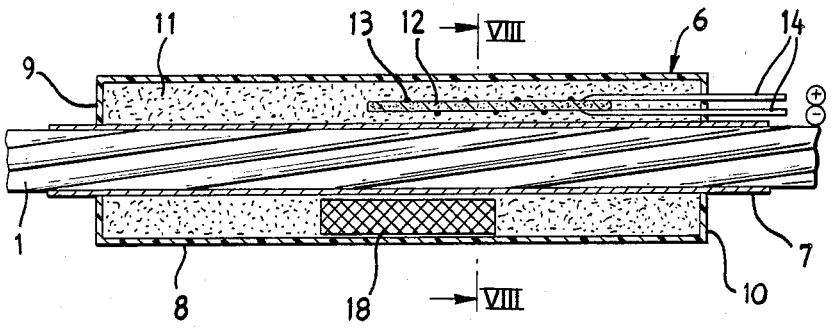
FIG. 7 is an enlarged detail view, similar to FIG. 2, illustrating an arrangement for applying external forces acting on the grouted anchor in the transverse direction.
Figure 8:
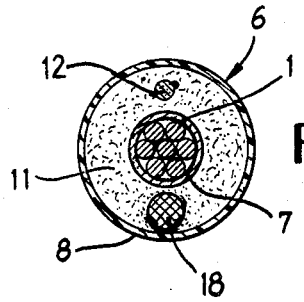
FIG. 8 is a cross-sectional view taken along the line VIII—VIII in FIG. 7.

In FIGS. 7 and FIG. 8 an explosive charge 18 is placed within the device 6 so that it detonates at a specific temperature and applies external forces acting transversely of the axial direction.

While specific embodiments of the invention have been shown and described in detail to illustrate the application of the inventive principles, it will be understood that the invention may be embodied otherwise without departing from such principles.

We claim:

1. Method of removing a portion of an axially elongated tension member in a prestressed grouted anchor within an elongated borehole in a receiving material where the borehole has a base part and wherein an axially extending first portion of the tension member is grouted into the base part of the elongated borehole and a remaining axially extending second portion within the borehole extends from the grouted portion and is free of the grout and the adjacent ends of the first and second portions form a transition section within the borehole, comprising the steps of prestressing the tension member under normal temperature conditions based on the length of the second portion within the borehole so that the tension member is elastically elongated for an elongation greater than the elongation required for severing the tension member under the action of heat at a given temperature above the normal temperature conditions, and reducing the tensile strength of the tension member by exposing the prestressed tension member in the transition section thereof within the borehole to the action of heat at least at the given temperature above the normal temperature conditions for automatically severing the second portions of the tension member from the first portion so that the severed axially extending second portion of the tension member can be removed from the borehole in the receiving material while the grouted axially extending first portion remains, and providing the heating action by an exothermic chemical reaction.

2. Method, as set forth in claim 1, including the step of increasing the prestressing force affording the elongation of the tension member by applying external axially acting forces at least during the exposure of the tension member to the action of heat.

3. Method, as set forth in claim 2, including the step of producing the external forces by applying spring elements acting on the second portion of the tension member.

4. Method, as set forth in claim 2, including the step of reducing the elongation required for severing under the action of heat by applying external forces.

5. Method, as set forth in claim 4, including the step of reducing the required elongation by applying forces acting on the second portion of the tension member in the direction transverse to the axial direction thereof.

6. Method, as set forth in claim 4, including the step of reducing the required elongation by subjecting the tension member to the action of dynamic stresses.

7. Method, as set forth in claim 1, including the step of reducing the elongation required for separating the tension member by controlling the heat supplied to the tension member.

8. Method, as set forth in claim 7, including selecting the duration of the heating action on the tension member as a function of the length of the axially extending second portion of the tension member.

9. Method, as set forth in claim 1, including the steps of replacing and increasing the prestressing force affording the elongation of the tension member by applying external axially acting forces at least during the exposure of the tension member to the action of heat.

10. Device for severing a prestressed grouted anchor including a prestressed tension member comprising sleeve assembly arranged to laterally enclose an axially extending portion of a prestressed tension member, said sleeve assembly comprises an inner sleeve having a relatively thin wall arranged to contact and extend around the outside surface of the tension member, an outer sleeve formed of an insulating material and laterally encircling and spaced outwardly from said inner sleeve, said outer sleeve having a thicker wall than said inner sleeve, an aluminothermic reaction mixture filled into the space between said inner and outer sleeves, and means for igniting said aluminothermic reaction mixture.

11. Device, as set forth in claim 10, wherein said inner sleeve is formed of a plastics material.

12. Device, as set forth in claim 10, wherein said inner sleeve is formed of sheet metal.

13. Device, as set forth in claim 10, wherein said outer sleeve is formed of one of an insulating plastics material and an insulating ceramic material.

14. Device, as set forth in claim 10, wherein said ignition means comprises a stable rod-shaped pyrotechnic mixture, and an ignition line in direct contact with said rod-shaped mixture so that a supply of electric power can be conducted to said pyrotechnic mixture.

15. Device, as set forth in claim 14, wherein said ignition line extends spirally around said rod-shaped mixture.

16. Device, as set forth in claim 10, wherein a pressure relief line is connected to said sleeve assembly and extends from the sleeve assembly to a location spaced from the anchored portion of the prestressed tension member.

17. Device, as set forth in claim 16, wherein a one-way valve connects said ring sleeve assembly to said pressure relief line.

* * * * *